US008342266B2

(12) United States Patent
Hall et al.

(10) Patent No.: US 8,342,266 B2
(45) Date of Patent: Jan. 1, 2013

(54) TIMED STEERING NOZZLE ON A DOWNHOLE DRILL BIT

(76) Inventors: David R. Hall, Provo, UT (US); Jonathan Marshall, Provo, UT (US); Scott Dahlgren, Alpine, UT (US)

( * ) Notice: Subject to any disclaimer, the term of this patent is extended or adjusted under 35 U.S.C. 154(b) by 0 days.

(21) Appl. No.: 13/048,707

(22) Filed: Mar. 15, 2011

(65) Prior Publication Data

US 2012/0234606 A1 Sep. 20, 2012

Related U.S. Application Data

(63) Continuation of application No. 13/048,595, filed on Mar. 15, 2011.

(51) Int. Cl.
*E21B 7/00* (2006.01)

(52) U.S. Cl. ..... 175/76; 175/67

(58) Field of Classification Search ..... 175/40, 175/76, 61, 67, 81

See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,367,733 | A | 6/1921 | Midgett |
| 1,460,671 | A | 7/1923 | Hebsacker |
| 1,544,757 | A | 7/1925 | Hufford |
| 2,169,223 | A | 8/1931 | Christian |
| 1,821,474 | A | 9/1931 | Mercer |
| 1,879,177 | A | 9/1932 | Gault |
| 2,054,255 | A | 9/1936 | Howard |
| 2,064,255 | A | 12/1936 | Garfield |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,038 | A | 3/1951 | Kammerer |
| 2,776,819 | A | 1/1957 | Brown |
| 2,891,043 | A | 1/1958 | Henderson |
| 2,838,284 | A | 6/1958 | Austin |
| 2,755,071 | A | 7/1958 | Kammerer |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,294,186 | A | 12/1966 | Buell |
| 3,301,339 | A | 1/1967 | Pennebaker |
| 3,379,264 | A | 4/1968 | Cox |
| 3,429,390 | A | 2/1969 | Bennett |
| 3,493,165 | A | 2/1970 | Schonfield |
| 3,583,504 | A | 6/1971 | Aalund |

(Continued)

*Primary Examiner* — David Bagnell
*Assistant Examiner* — Kipp Wallace
(74) *Attorney, Agent, or Firm* — Phillip W. Townsend, III

(57) ABSTRACT

In one aspect of the present invention, a downhole rotary steerable system comprises a fluid path defined by a bore formed within a drill string component. A valve located within a wall of the bore which hydraulically connects the bore with a fluid cavity. A steering nozzle disposed on the drill string component and in communication with the fluid cavity. The valve is configured to control flow from the bore to the fluid cavity with an azimuthal sensing mechanism configured to determine the azimuth of the steering nozzle and instrumentation configured to control the valve based off of input from the azimuthal sensing mechanism.

16 Claims, 13 Drawing Sheets

U.S. PATENT DOCUMENTS 3,746,108 A * 7/1973 Hall ..... 175/61
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,803,185 A * 9/1998 Barr et al. ..... 175/45
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,257,356 B1 * 7/2001 Wassell ..... 175/61
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswami
6,929,076 B2 8/2005 Fanuel
6,953,096 B2 10/2005 Gledhill
2008/0000693 A1 * 1/2008 Hutton ..... 175/61
2008/0128174 A1 * 6/2008 Radford et al. ..... 175/267

* cited by examiner

TIMED STEERING NOZZLE ON A DOWNHOLE DRILL BIT

CROSS REFERENCE TO RELATED APPLICATIONS

This application is a continuation of U.S. patent application Ser. No. 13/048,595, which was filed on Mar. 15, 2011 and is herein incorporated by reference for all that it contains.

BACKGROUND OF THE INVENTION

The present invention relates to the field of steering assemblies used for downhole directional drilling. The prior art discloses directional drilling drill bit assemblies.

U.S. Pat. No. 5,553,678 to Barr et al., which is herein incorporated by reference for all that it contains, discloses a modulated bias unit is provided for controlling the direction of drilling of a rotary drill bit when drilling boreholes in subsurface formations. The unit comprises a plurality of hydraulic actuators spaced apart around the periphery of the unit and having movable thrust members hydraulically displaceable outwardly for engagement with the formation of the borehole being drilled. Each actuator has an inlet passage for connection to a source of drilling fluid under pressure and an outlet passage for communication with the annulus. A selector control valve connects the inlet passages in succession to the source of fluid under pressure, as the unit rotates, and a choke is provided to create a pressure drop between the source of fluid under pressure and the selector valve. A further choke is provided in the outlet passage from each actuator unit. The actuators and control valve arrangements may take a number of different forms.

U.S. Pat. No. 4,416,339 to Baker et al., which is herein incorporated by reference for all that it contains, discloses a mechanism and method for positive drill bit guidance during well drilling operations. The guidance device includes a control arm or paddle which, due to hydraulic pressure, pivots to steer the drill bit towards its target area. As the paddle applies pressure to the wall of the well, the drill bit is then turned from the contacted area of the well wall in the desired direction.

U.S. Pat. No. 5,582,259 to Barr et al., which is herein incorporated by reference for all that it contains, discloses a modulated bias unit, for controlling the direction of drilling of a rotary drill bit when drilling boreholes in subsurface formations, comprises a number of hydraulic actuators spaced apart around the periphery of the unit. Each actuator comprises a movable thrust member which is hydraulically displaceable outwardly and a formation-engaging pad which overlies the thrust member and is mounted on the body structure for pivotal movement about a pivot axis located to one side of the thrust member. A selector control valve modulates the fluid pressure supplied to each actuator in synchronism with rotation of the drill bit so that, as the drill bit rotates, each pad is displaced outwardly at the same selected rotational position so as to bias the drill bit laterally and thus control the direction of drilling. The pivot axis of the formation-engaging member is inclined to the longitudinal axis of rotation of the bias unit so as to compensate for tilting of the bias unit in the borehole during operation.

BRIEF SUMMARY OF THE INVENTION

In one aspect of the present invention, a downhole rotary steerable system comprises a fluid cavity defined by a bore formed within a drill string component. A valve may be located within the wall of the bore, which hydraulically connects the bore with the fluid cavity. A steering nozzle may be disposed on the drill string component and in communication with the fluid cavity. The valve is configured to control flow from the bore to the fluid cavity and an azimuthal sensing mechanism may be configured to determine the azimuth of the steering nozzle. Instrumentation may be configured to control the valve based off of input from the azimuthal sensing mechanism.

The azimuthal sensing mechanism may comprise a plurality of accelerometers configured to transmit a signal to the instrumentation that actuates the valve through the use of a motor. The azimuthal sensing mechanism may also comprise at least one magnetometer which measures azimuth position, wherein the azimuthal sensing mechanism is configured to calibrate the valve using the input from the magnetometer. The steerable system may further comprise at least one expandable element supported by the drill string component and in communication with at least one fluid cavity. The expandable element may be disposed opposite the steering nozzle on the drill string element.

The diameter of the steering nozzle may be smaller than the diameter of the valve such that a pressure differential is created that forces the expandable element to extend and results in ejecting the fluid through the steering nozzle at the formation with increased force. The expandable element may be configured to shift the center axis of the drill string away from the center axis of the borehole. Each expandable element and steering nozzle may be in fluid communication with a steering nozzle and expandable element.

The instrumentation may be configured to actuate each valve separately. The valve may be configured to be actuated by a motor powered by a turbine generator. The turbine generator may also be configured to power the azimuthal sensing mechanism. The valve, azimuthal sensing mechanism, and instrumentation may be disposed within a housing. The housing may be inserted into the bore of the drill string component and the fluid cavity may comprise an annular shape formed between the housing and the drill string component.

DETAILED DESCRIPTION OF THE INVENTION AND THE PREFERRED EMBODIMENT

Figure 1:
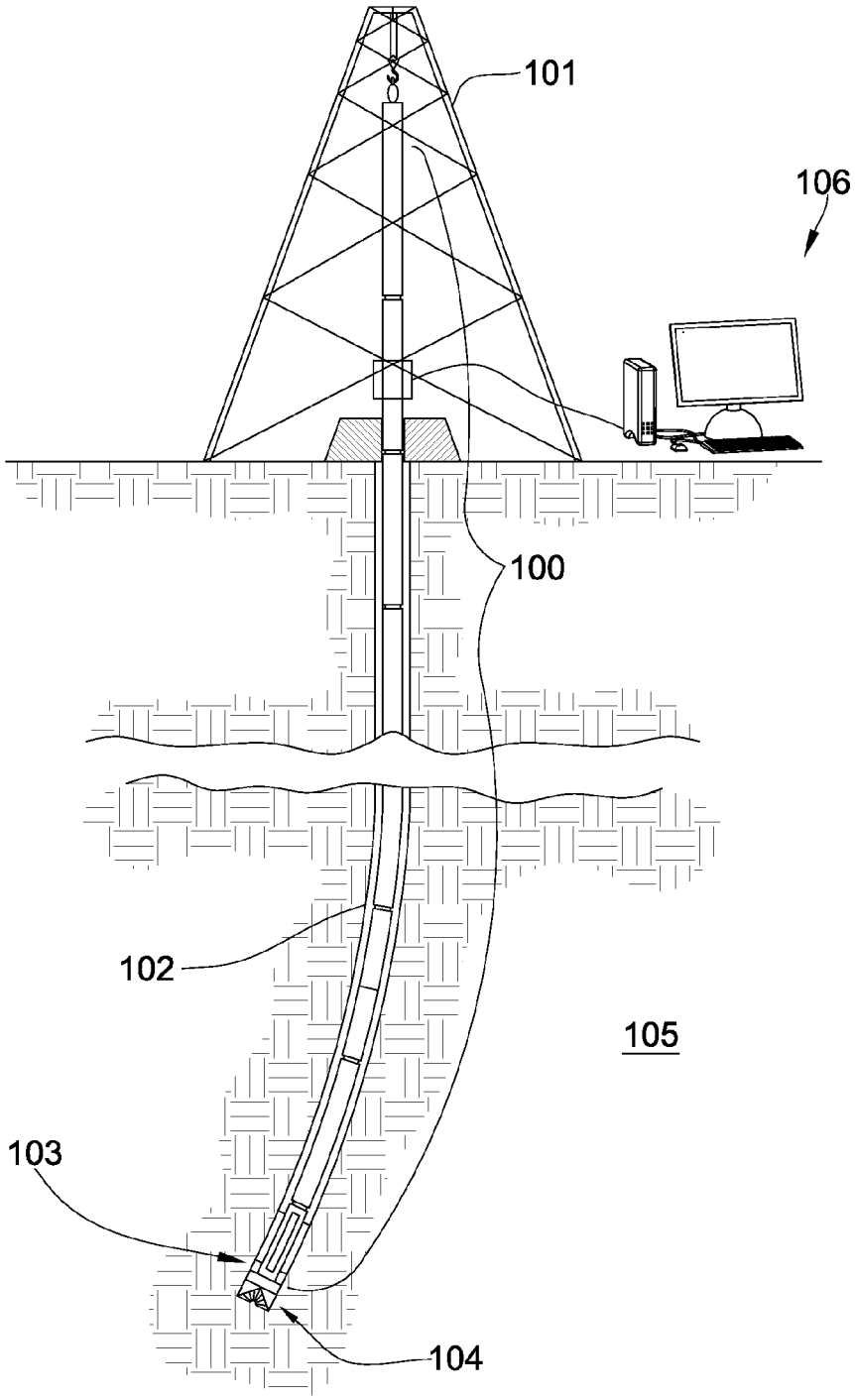
FIG. 1 is a perspective view of an embodiment of a drill string suspended from a drill rig.

Referring now to the figures, FIG. 1 is a perspective view of an embodiment of a drilling operation comprising a downhole tool string 100 suspended by a derrick 101 in a wellbore 102. A steerable system 103 may be located at the bottom of the wellbore 102 and may comprise a drill bit 104. As the drill bit 104 rotates downhole, the downhole tool string 100 advances farther in to the earth. The downhole tool string 100 may penetrate soft or hard subterranean formations 105. The steerable system 103 may be adapted to steer the drill string 100 in a desired trajectory. The downhole tool string 100 may comprise electronic equipment capable of sending signals through a data communication system to a computer or data logging system 106 located at the surface.

Figure 2:
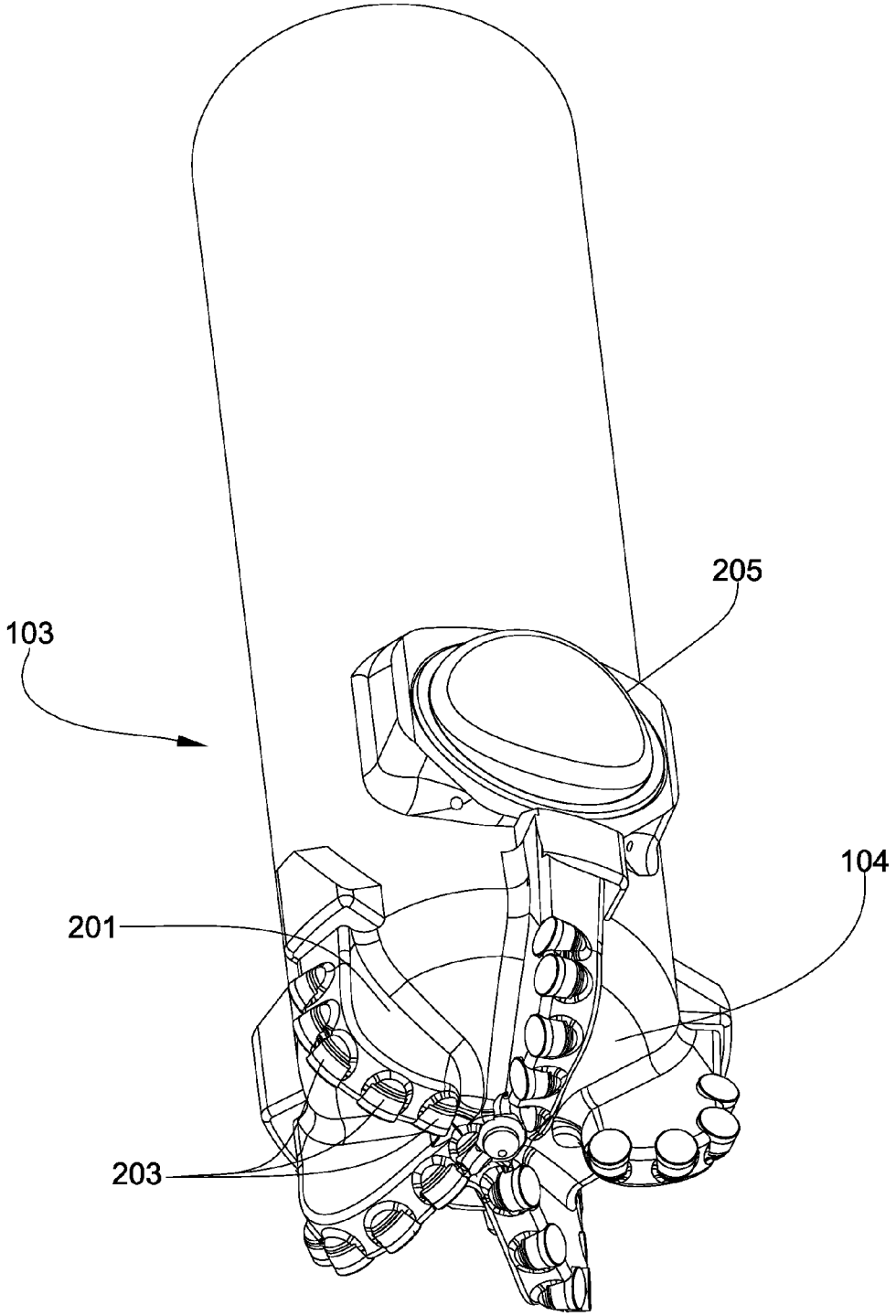
FIG. 2 is a perspective view of an embodiment of a steerable system.

FIG. 2 discloses a drill bit 104 with a plurality of fixed blades 201. The fixed blades 201 may comprise a plurality of cutters 203 such that as the drill string rotates the cutters penetrate into the earthen formation. An expandable element 205 may be disposed adjacent to the drill bit 104. The expandable element 205 may extend away from the axis of the drill string into an earthen formation shifting the axis of the drill string away from the axis of the borehole.

Figure 3:
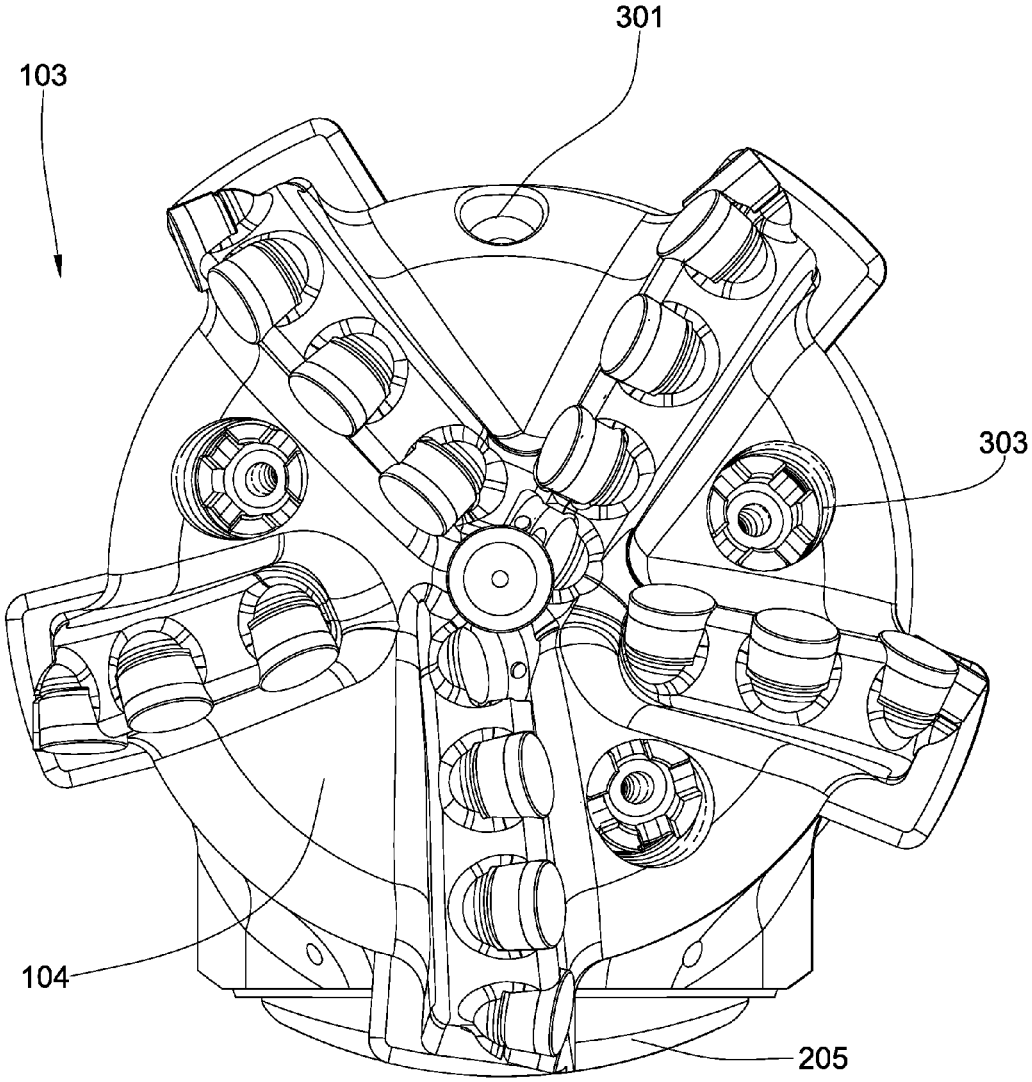
FIG. 3 is a perspective view of an embodiment of a steerable system.

FIG. 3 discloses a steering nozzle 301 disposed adjacent to the working face of the drill bit 104 opposite the expandable element 205. The steering nozzle 301 may be configured to direct fluid away from the drill bit 104 and towards an earthen formation. The drill bit 104 may comprise a plurality of fixed blades 201 evenly spaced on the working face. The blades 201 may comprise a plurality of cutters 203 disposed on the blade 201. At least one drilling nozzle 303 may be disposed between each fixed blade 201 and configured to direct fluid toward the plurality of cutters 203 removing excess cutting debris from the working face of the drill bit 104.

Figure 4A:
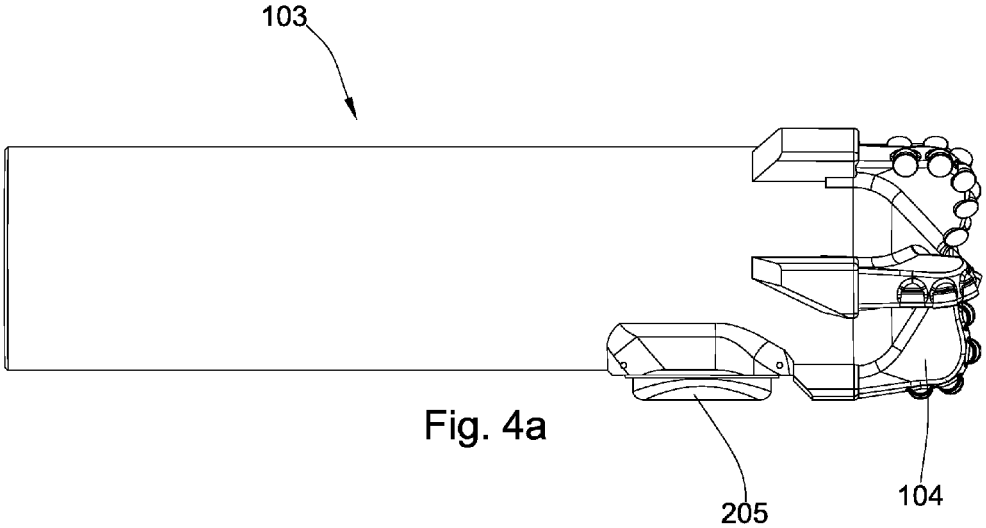
FIG. 4*a* is a perspective view of an embodiment of a steerable system.
Figure 4B:
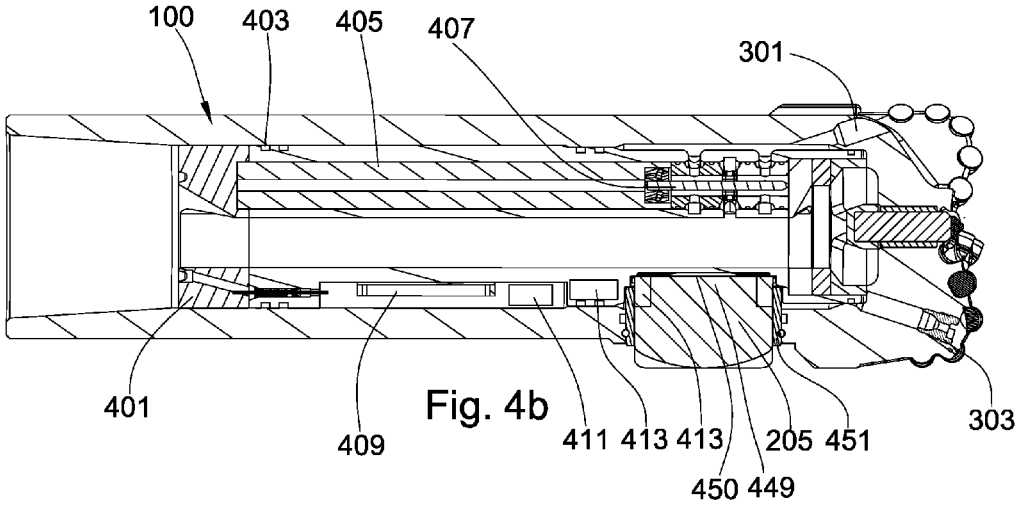
FIG. 4*b* is a cross-sectional view of an embodiment of a steerable system.

FIGS. 4*a* and 4*b* are perspective and cross-sectional views of another embodiment of a steerable system 103. The system 103 may comprise an expandable element 205 disposed on a drill string 100 attached to a drill bit 104. The drill string 100 may comprise a generally outer annular surface, and the steering nozzle 301 and the expandable element 205 may both be supported by the generally outer annular surface, but positioned opposite each other. In some embodiments the steering nozzle may be disposed on a gauge of a drill bit.

A housing 401 that contains some of the mechanism in the steering system may be inserted into the bore of the drill string 100. O-rings 403 may provide a fluid seal between the housing 401 and the inner surface of the drill string's bore. The housing 401 may comprise a cylindrical geometry (or another geometry complimentary to the inner surface of the bore). The thickness of the housing wall may comprise a motor 405 to operate a valve 407, the valve 407, an orientation sensing mechanism instrumentation 409, and part of an expandable element 205. The orientation sensing mechanism may comprise instrumentation that determines the azimuth of the drill string component. The orientation/azimuthal sensing mechanism may comprise an accelerometer 411 and a magnetometer 413.

The expandable element 205 may extend through an opening in a side of the drill string 100. The opening in the drill string may correspond with an opening in the housing. As fluid is directed towards a surface 449 on a back end 450 of the expandable element 205, the fluid cavity may be pressurized and fluid pressure may exert a force on the surface 449 of the back end 450 to extend the expandable element 205. Seals 451 disposed between the opening wall and the expandable element may prevent leaks. In some embodiments, a small leak is acceptable to keep debris from clogging the interference between the expandable element and the opening. Also, a stopping mechanism may be incorporated into the present invention to retain the expandable element within the opening while allowing the expandable element to translate within the opening.

The motor 405 may be mechanically connected to the valve 407. The instrumentation 409 may be in electrical communication with the motor 405, and thus, control the valve. In the present embodiment, the orientation sensing mechanism may be an azimuthal sensing mechanism configured to detect the orientation of the drill bit 104 downhole and transmit that data to the instrumentation 409 through the use of at least one accelerometer and magnetometer 411, 413. A processing element of the instrumentation 409 may compute when to activate the motor 405 based on this downhole data or from a separate input received from the surface.

Accelerometers may be used to track the azimuth of the nozzle and expandable element. In some embodiments, a magnetometer may be used to compensate for rotational drift defined as a gradually increasing inconsistency between the accelerometer readings and the actual location of the nozzles and expandable element. The instrumentation 409 may be configured to compensate for timing delays between the acquisition of data and actuation of the valve as well as the delay between the actuation of the valve and the actuation of the expandable element, thus, facilitating a more precise change in direction while drilling.

Figure 5A:
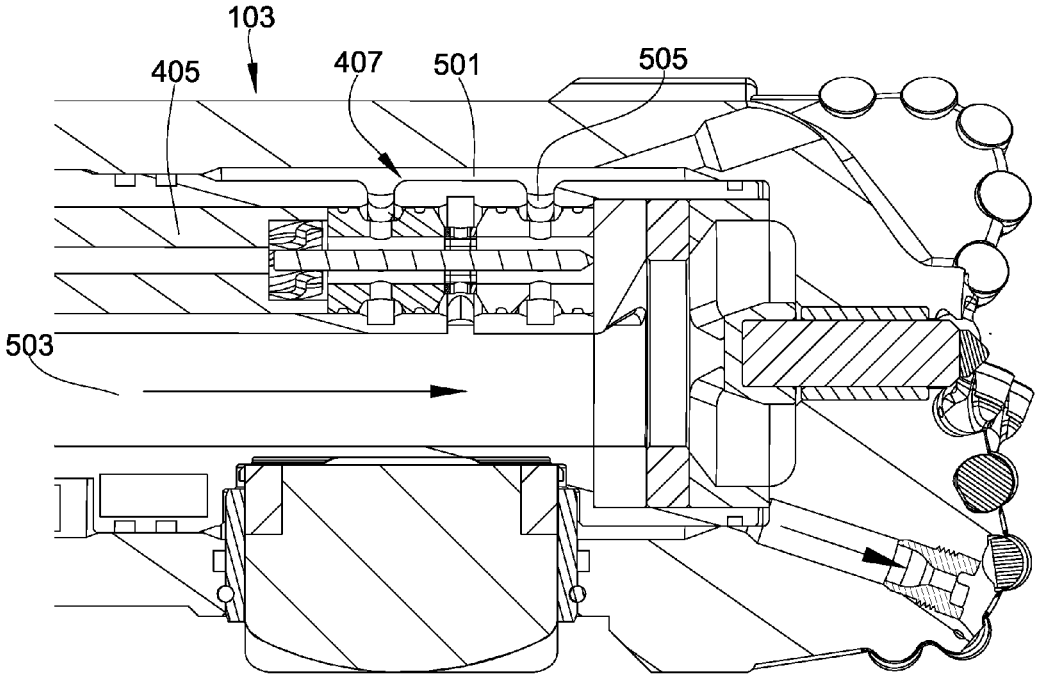
FIG. 5*a* is a cross-sectional view of an embodiment of a steerable system.
Figure 5B:
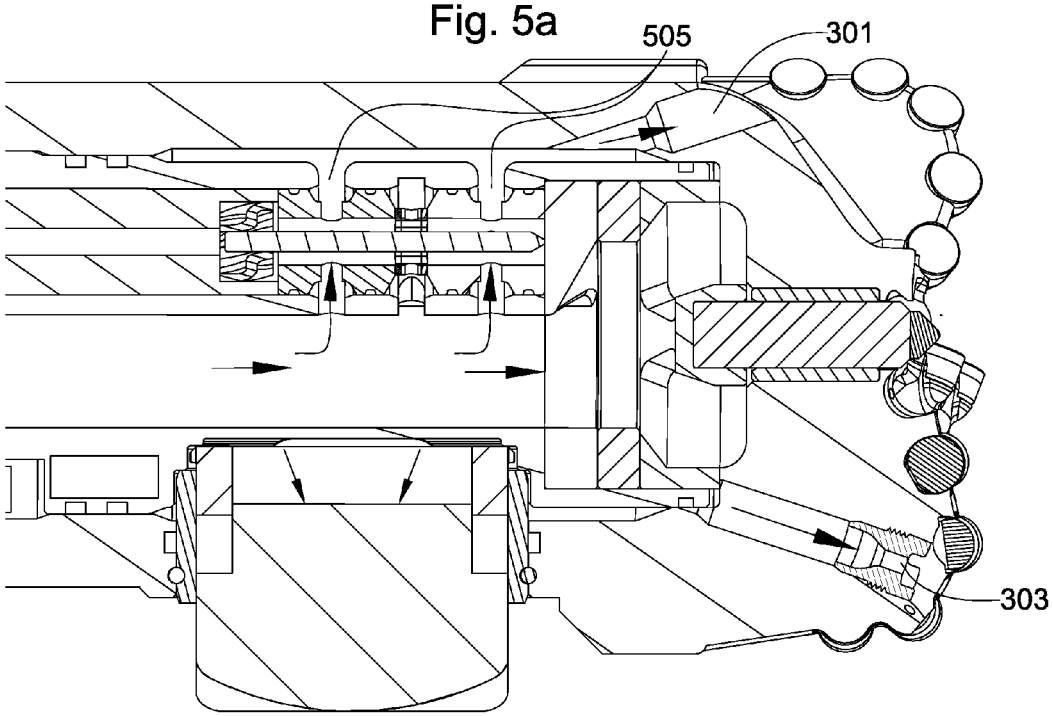
FIG. 5*b* is a cross-sectional view of an embodiment of a steerable system.

FIGS. 5*a* and 5*b* are cross-sectional views of an embodiment of a steerable system 103. FIG. 5*a* discloses the steerable system 103 with the valve 407 closed. The closed valve 407 results in all drilling fluid being directed to the drilling nozzles 303 in the working face of the drill bit 104. FIG. 5*b* discloses the valve 407 open and directing a portion of the drilling fluid into the fluid cavity 501, and thus, to the steering nozzle 301 and expandable element 205.

The valve 407 may comprise a plurality of ports 505 configured to direct fluid from the bore 503 of the drill string to the compressible fluid cavity 501. The ports 505 may be aligned with the bore 503 through the use of a motor 405. As the motor 405 rotates the valve 407, the ports 505 may open and close to the bore 503. When open, the valve directs a portion of the drilling fluid from the bore 503 and into the compressible fluid cavity 501. The valve 407 may be a rotary valve, ball valve, butterfly valve, or any valve that can be used to regulate fluid.

The fluid may enter the compressible fluid cavity 501 and be directed to a steering nozzle 301 and an expandable element 205. The path to the expandable element 205 may comprise a larger cross sectional area than the steering nozzle 301, thus, directing more fluid to the expandable element 205 than to the steering nozzle 301. In some embodiments, the back end of the expandable element may comprise a greater area than the opening in the steering nozzle. The expandable element 205 may come into contact with the earthen formation directing the drill string in the opposite direction of the earthen formation while forcing more fluid through the steering nozzle 301. The steering nozzle 301 may comprise a smaller diameter than the ports 505 creating a greater pressure differential in the compressible fluid cavity 501 from the restriction of fluid passing through the steering nozzle 301. The greater pressure differential may result in the fluid from the steering nozzle 301 being directed at a greater velocity than the fluid from the drilling nozzles 303.

Figure 6:
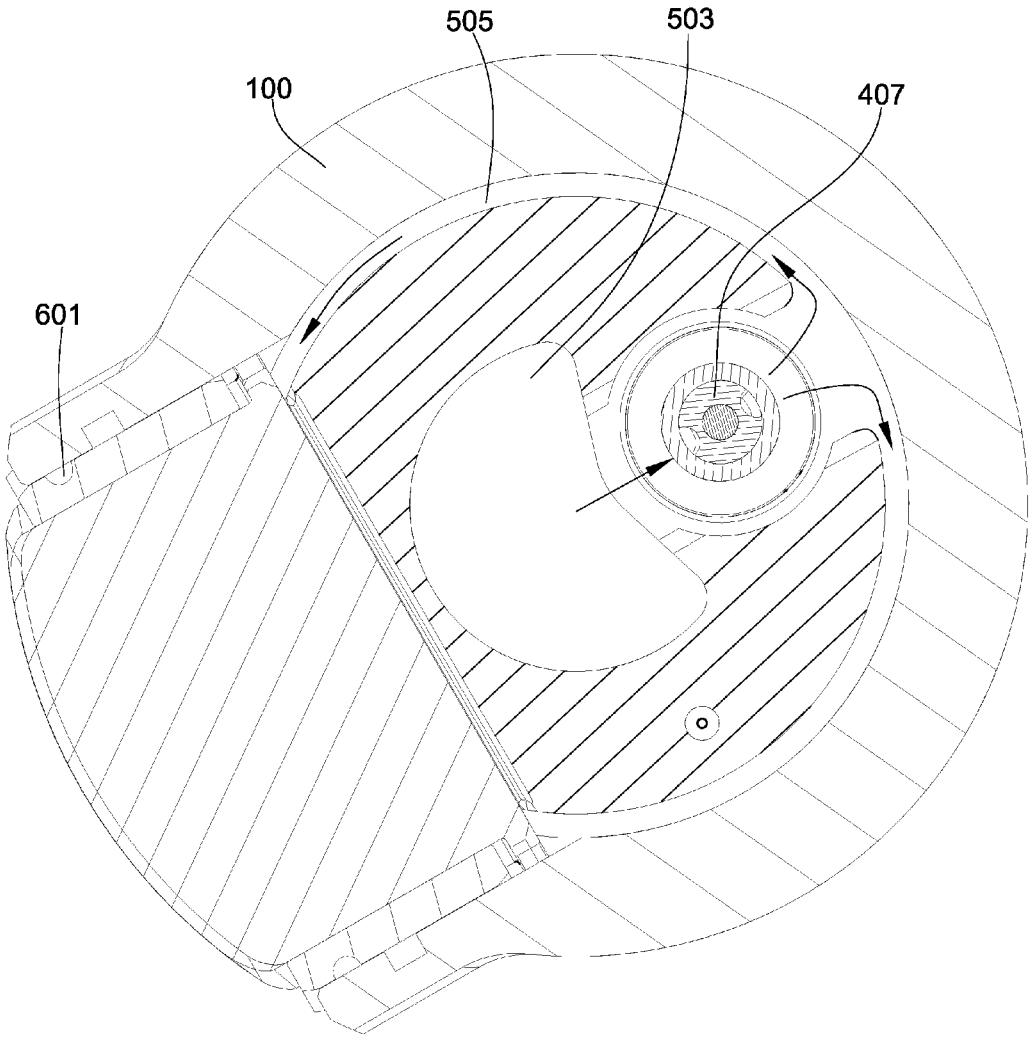
FIG. 6 is a cross-sectional view of an embodiment of a steerable system.
Figure 7:
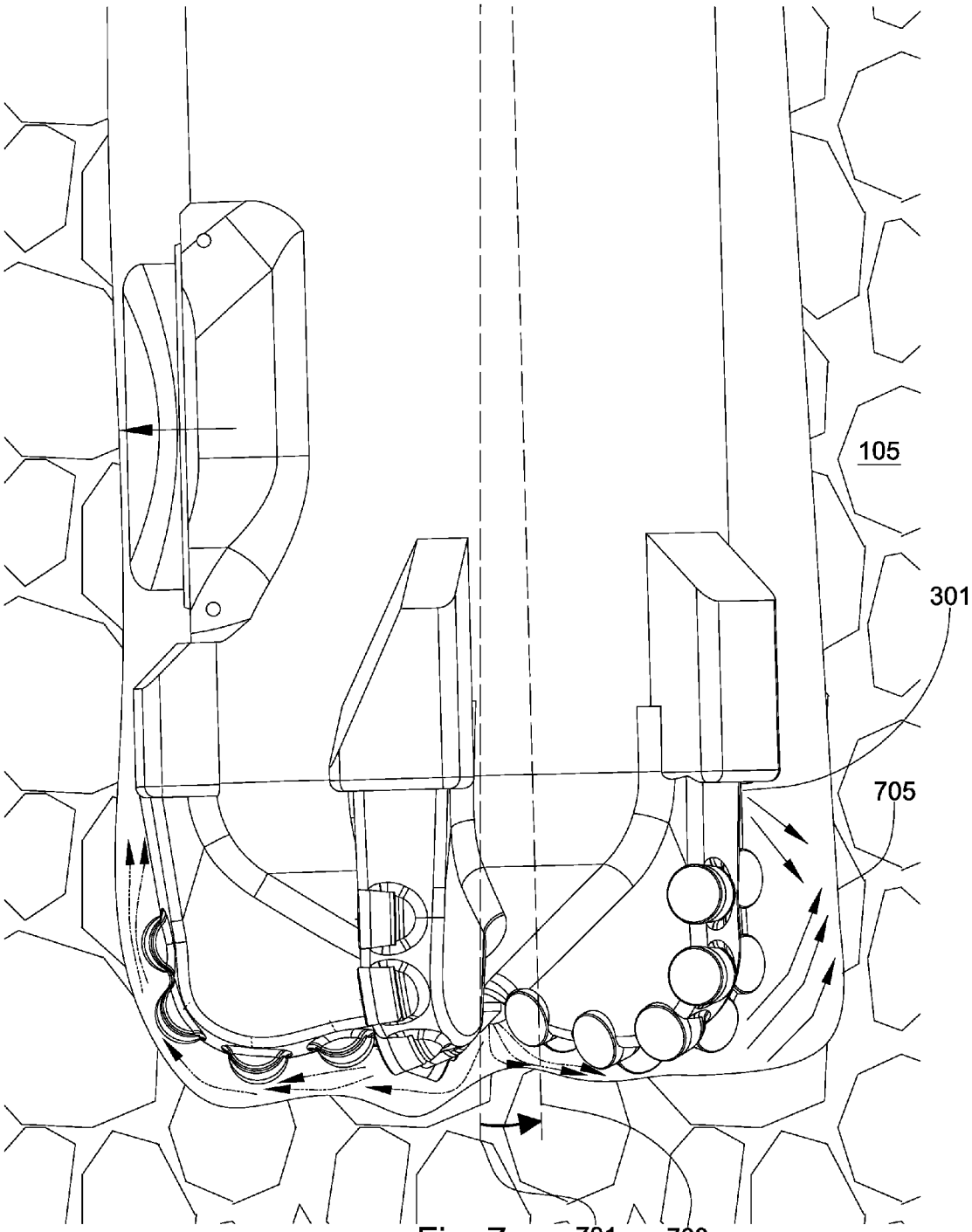
FIG. 7 is a perspective view of another embodiment of a steerable system.

FIG. 6 is a cross-sectional view of an embodiment of a steerable system 103. The cross-section discloses the expandable element 205 in fluid communication with the valve 407 through the compressible fluid cavity 501. The steering nozzle may be disposed on the opposite side of the drill string from the expandable element. Preferably, when the valve is open to the drilling fluid in the drill string's bore, the fluid is in fluid communication with both the steering nozzle and the back end of the expandable element at the same time. The compressible fluid cavity from the valve to the back end of the expandable element may form a circular geometry. In some embodiments, the cavity is formed radially to the bore and provides multiple routes to the expandable element. In some embodiments, the cavity is formed between an outer surface of the housing (shown in FIG. 4*b*) and the inner surface of drill string. In part the bore may be formed by the housing. The expandable element 205 may comprise at least one O-ring 601 forming a fluid seal between the expandable element 205 and any fluids outside the drill string FIG. 7 is a perspective view of a steerable system 103 disposed within a borehole formed in an earthen formation 105 with a first axis of rotation 701. As fluid flows through the fluid cavity, the expandable element 205 may extend toward the earthen formation 105 while fluid is being directed at the earthen formation 105 through the steering nozzle 301 on the opposite side of the expandable element 205. As the expandable element 205 extends and makes contact with the earthen formation 105 the axis of rotation may shift to a second axis 703. Fluid may continue to exit through the drilling nozzles and mix with the fluid from the steering nozzle 301. The fluid from the steering nozzle 301 may exit at a greater velocity than the fluid from the drilling, face nozzles, thus, directing the force of drilling fluid into a portion of the formation's wall forming an eroded area 705, and the expandable element is configured to urge the drill into the eroded area 705.

Figure 8:
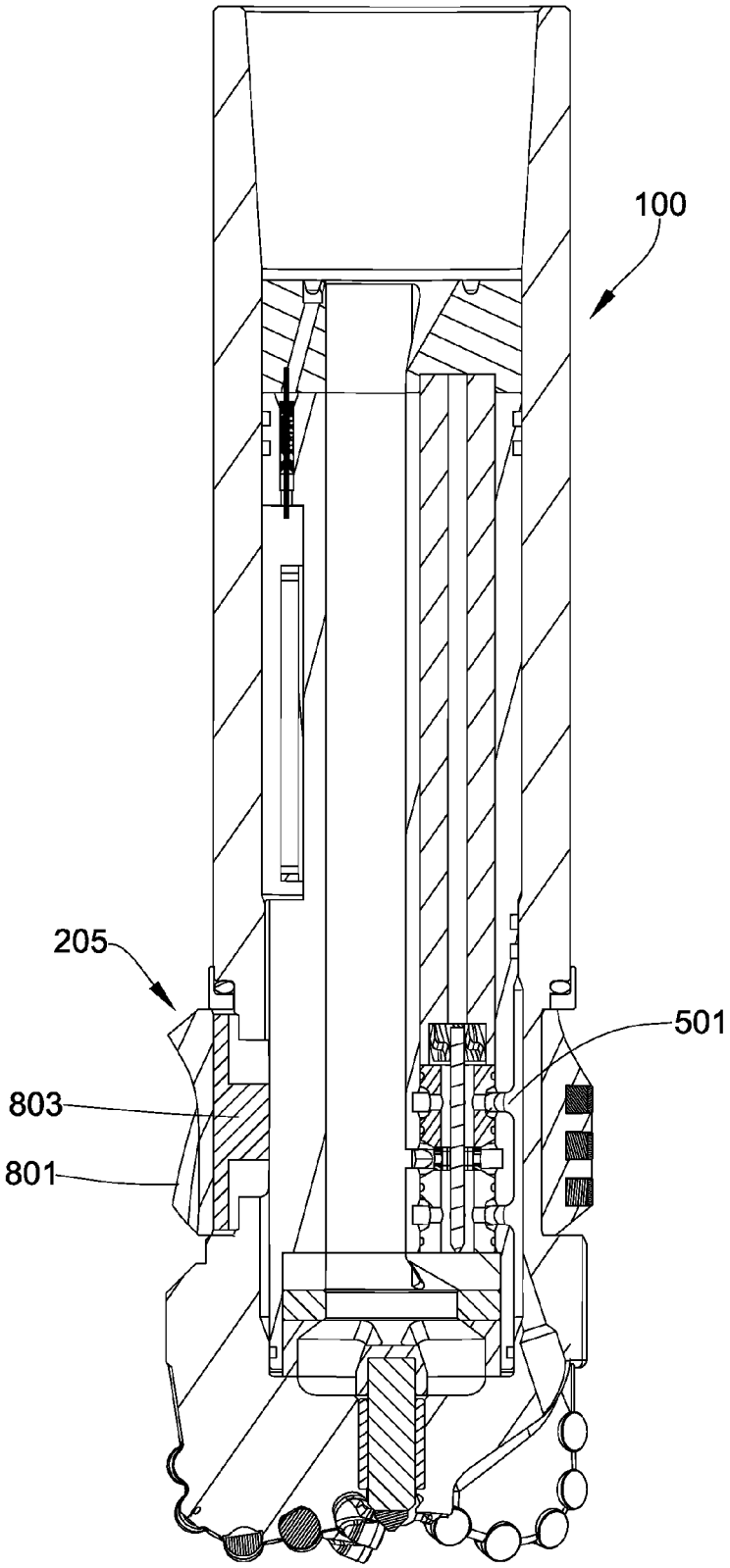
FIG. 8 is a cross-sectional view of another embodiment of a steerable system.

FIG. 8 is a cross-sectional view of another embodiment of a steerable system 103. The system may comprise an expandable element 205 comprising a ring 801 disposed around the outer diameter of the drill string 100. The ring 801 may comprise a single, continuous body and be in mechanical connection with a billows, an inflatable bladder, a piston, a ball, or combinations thereof. In the present embodiment, the ring 801 is in mechanical communication with a piston 803. The piston 803 may be disposed in the fluid cavity 501 such that the fluid in the cavity may actuate the piston 803, thus, extending the ring 801 away from the drill string.

Figure 9:
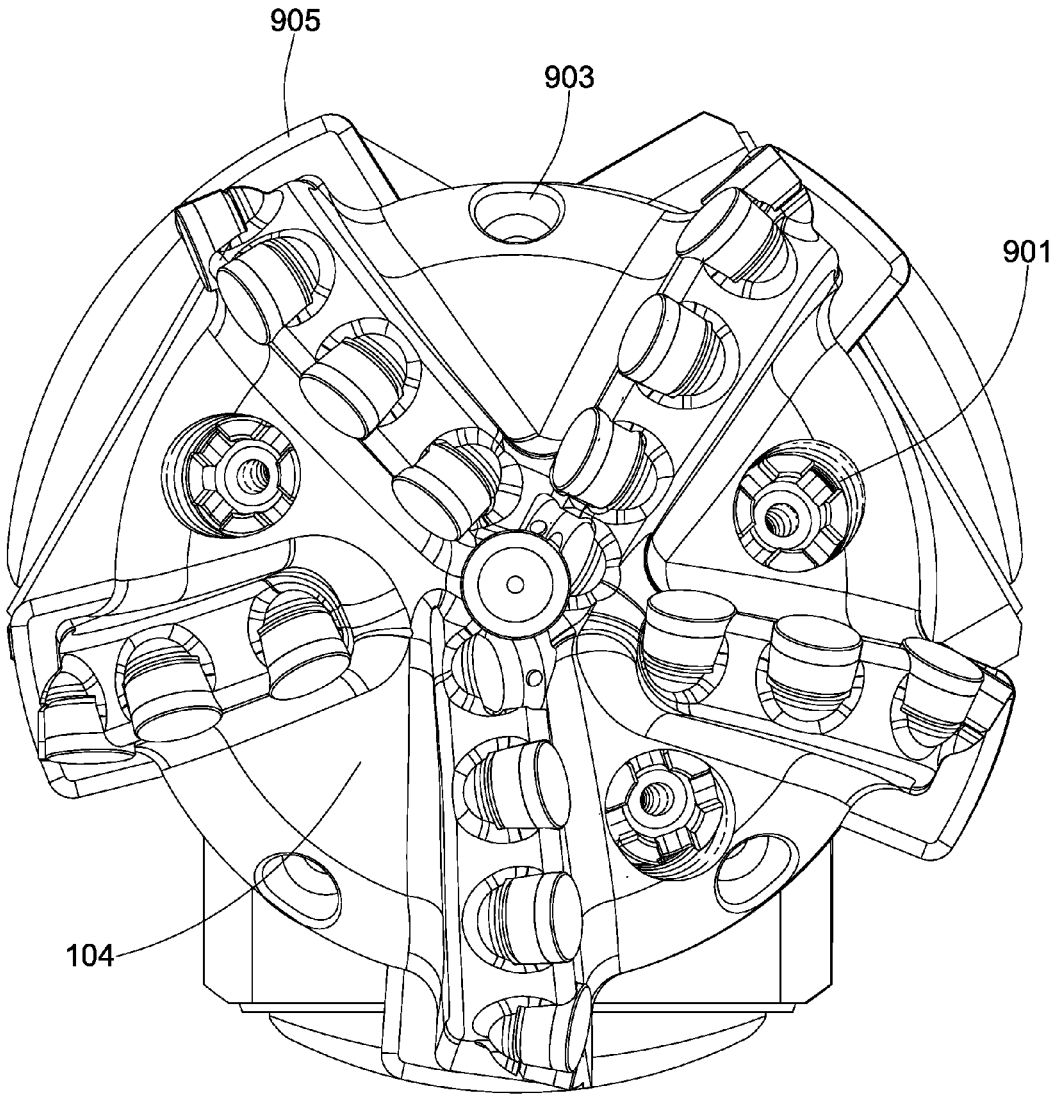
FIG. 9 is a perspective view of another embodiment of a steerable system.

FIG. 9 is a perspective view of another embodiment of a steerable system 103. The system may comprise a plurality of drilling face nozzles 901 disposed on the working face of the drill bit and a plurality of steering nozzles 903 disposed on the side of the drill bit 104. A plurality of expandable elements 905 may be disposed evenly around the circumference of the drilling string adjacent to the drill bit 104. Each steering nozzle 903 may be configured to direct drilling fluid independently of each other steering nozzle 903. Each steering nozzle 903 may be in fluid communication with a separate compressible fluid cavity. Each expandable element 905 may be disposed directly across from a steering nozzle 903 and be in fluid communication with said nozzle through a compressible fluid cavity. Each pair of steering nozzles and expandable element may function together at specific moments to change the trajectory or steer the drill string. A control board may be configured to synchronize the steering nozzles 901 and expandable elements 903 to activate while in the same direction while drilling thus increasing the speed at which a direction can be changed while drilling. The compressible fluid cavities for each pair of expandable elements and steering nozzles may be independent of the other cavities. In some embodiments, switches may provide some intentional fluid communication between the cavities.

Figure 10:
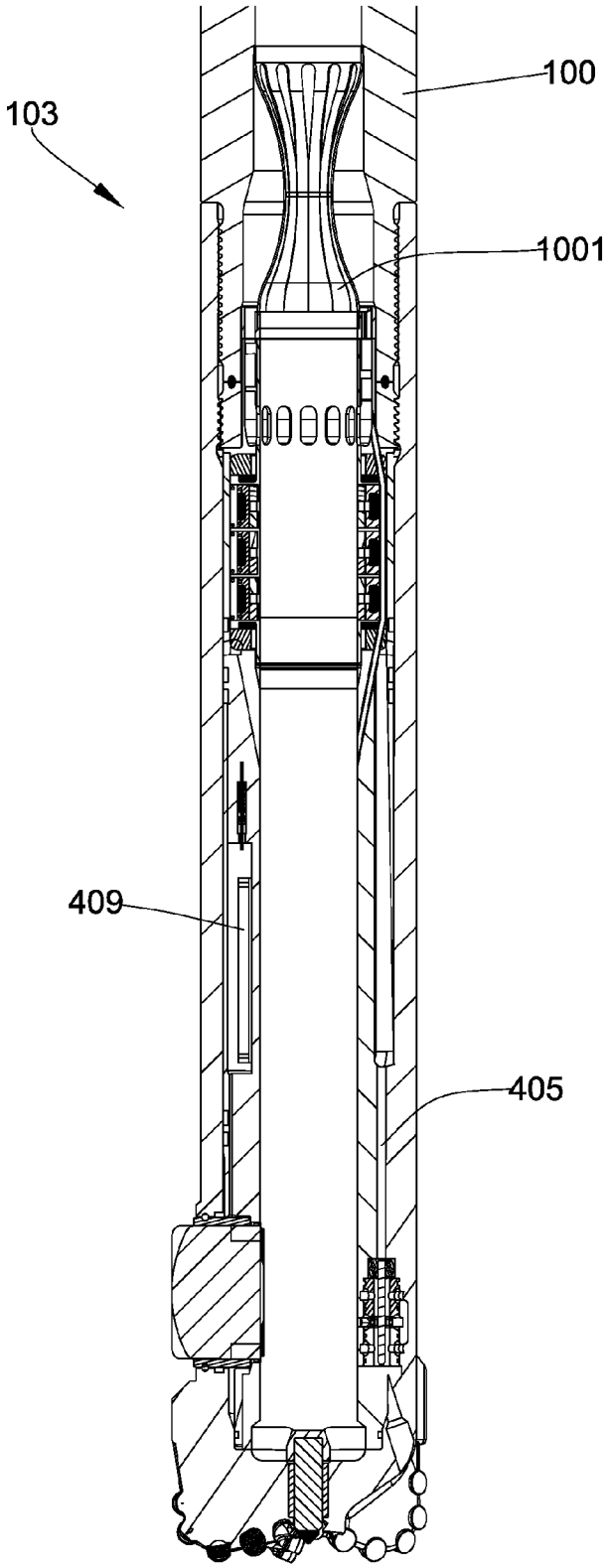
FIG. 10 is a cross-sectional view of another embodiment of a steerable system.

FIG. 10 is a cross-sectional view of another embodiment of a steerable system 103. The system discloses a generator 1001 disposed within the bore 503 of the drill string 100. The generator 1001 may be configured to provide power to the motor 405 and the control board 409.

Figure 11A:
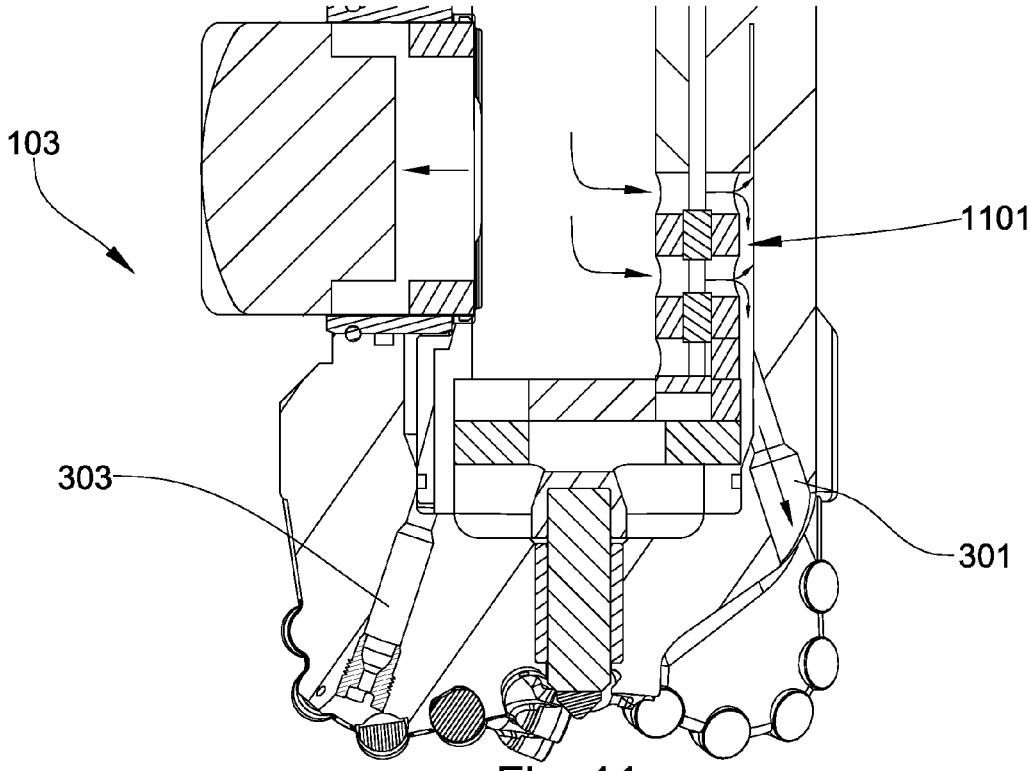
FIG. 11*a* is a cross-sectional view of another embodiment of a steerable system.
Figure 11B:
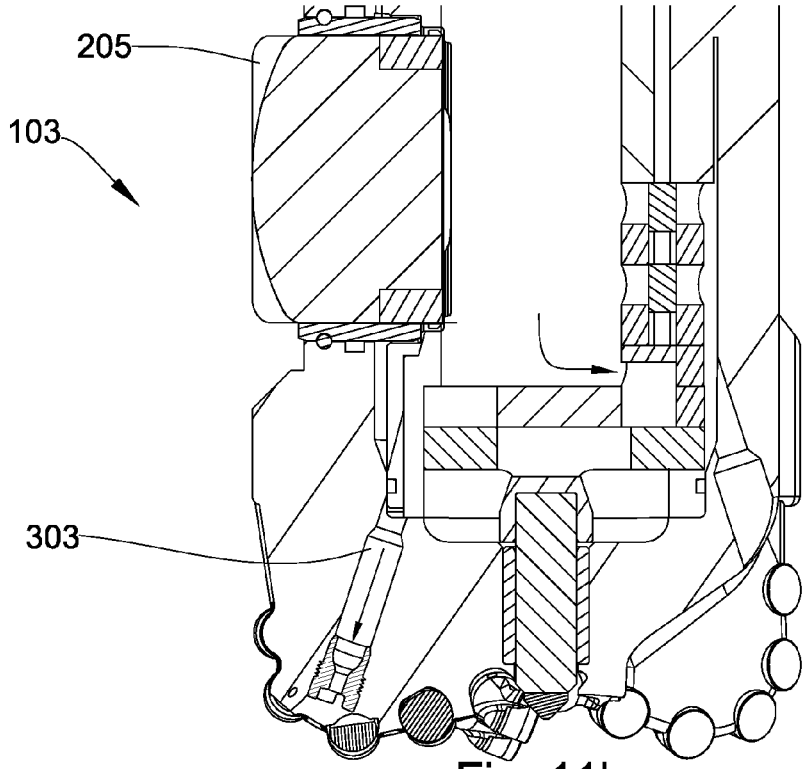
FIG. 11*b* is a cross-sectional view of another embodiment of a steerable system.

FIGS. 11*a* and 11*b* are cross-sectional views of another embodiment of a steerable system 103. The system 103 may comprise a reciprocating valve 1101 configured to direct all fluid to the at least one steering nozzle 301 disposed on the side of the drill bit 104 or to direct all drilling fluid to the at least one drilling nozzle 303 disposed on the working face of the drill bit 104.

FIG. 11*a* discloses the valve 1101 open to the bore of the drill string and directing fluid to the expandable element and the steering nozzle. However, the geometry of the valve also simultaneously blocks fluid from the face, drilling nozzles. Thus, while the fluid is directed to the steering nozzles, the fluid is also temporarily blocked to the face, drilling nozzles. Such an arrangement many provide at least two advantages. First, more hydraulic power may be provided to the steering nozzle and expandable element. Second, the fluid ejected from the face, drilling nozzles may have a lower propensity to interfere with the fluid ejected from the steering nozzle. Third, the temporary blockage may induce a vibration in the fluid ejected from the face, drilling nozzles, which may provide an additional destructive force into the formation. FIG. 11*b* discloses the valve 1101 closed to the bore and thus, directing the fluid to the drilling nozzles 303.

Figure 12A:
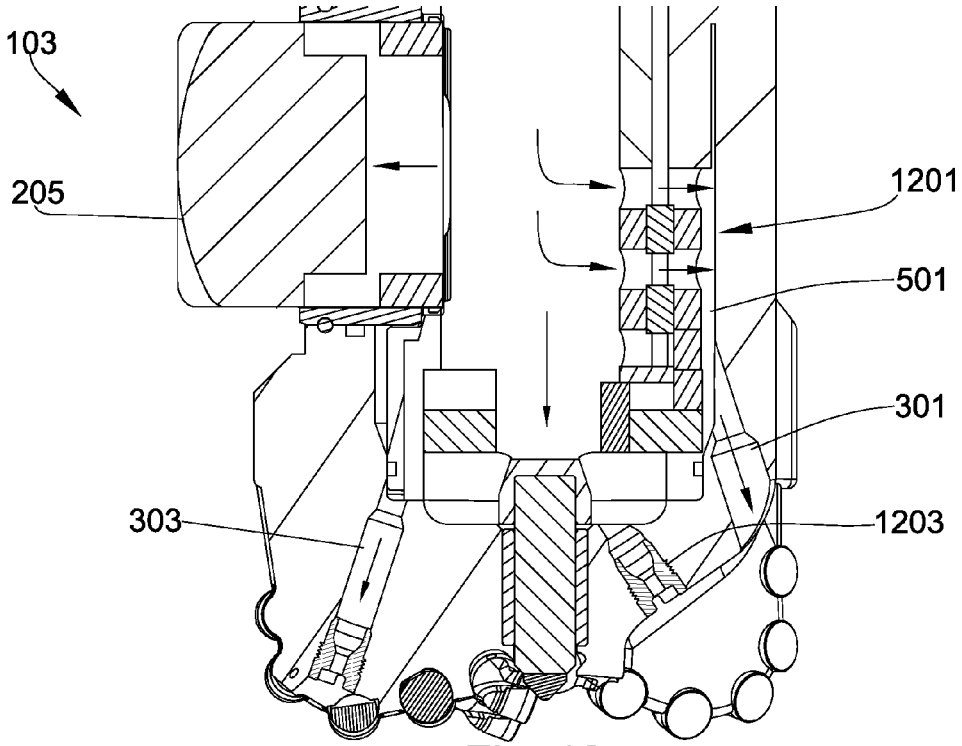
FIG. 12*a* is a cross-sectional view of another embodiment of a steerable system.
Figure 12B:
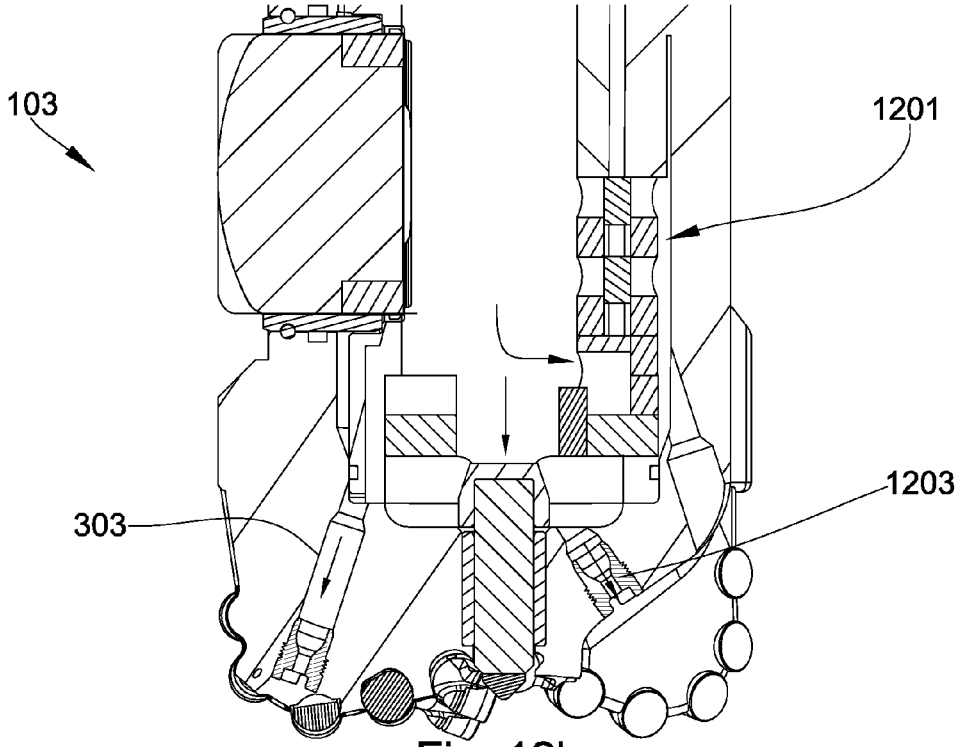
FIG. 12*b* is a cross-sectional view of another embodiment of a steerable system.

FIGS. 12*a* and 12*b* disclose a reciprocating valve 1201 configured to alternate drilling fluid between a fluid cavity 501, and thus to the steering nozzle and expandable element, and to a single drilling nozzle 1203 disposed nearby the steering nozzle 301. FIG. 12*a* discloses the valve directing fluid to the fluid cavity 501 while blocking the fluid flow to the drilling nozzle. FIG. 12*b*, on the other hand, discloses the valve 1201 directing fluid to the drilling nozzle 1203 while blocking the fluid to the steering nozzle 301.

Figure 13A:
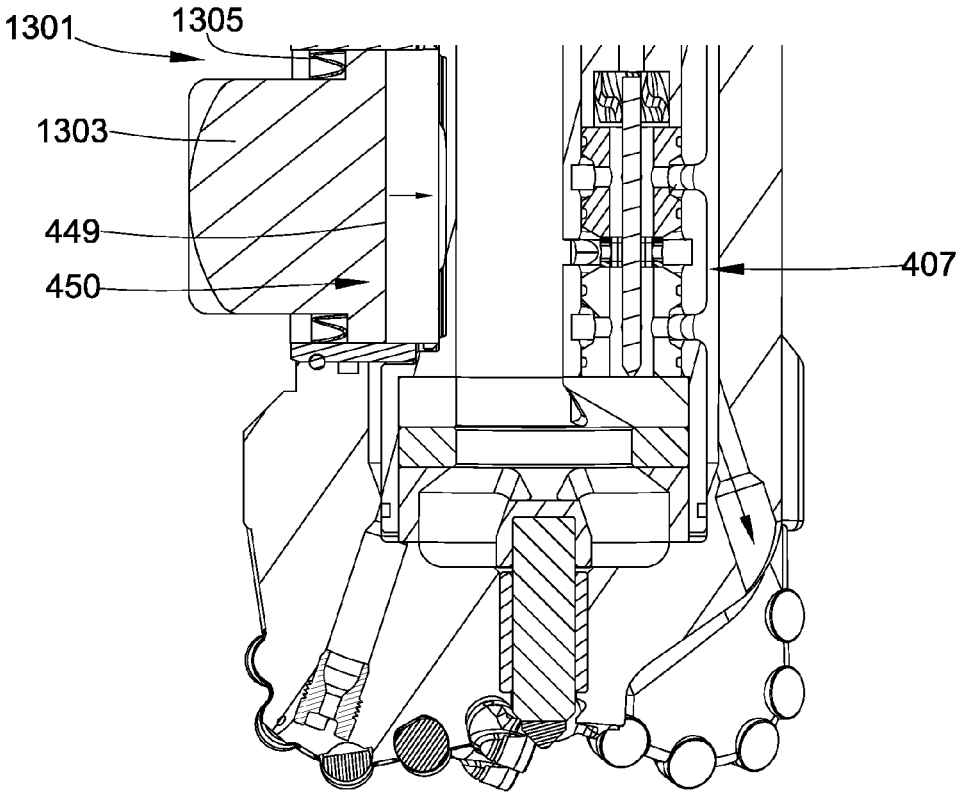
FIG. 13*a* is a cross-sectional view of an embodiment of a retraction mechanism.
Figure 13B:
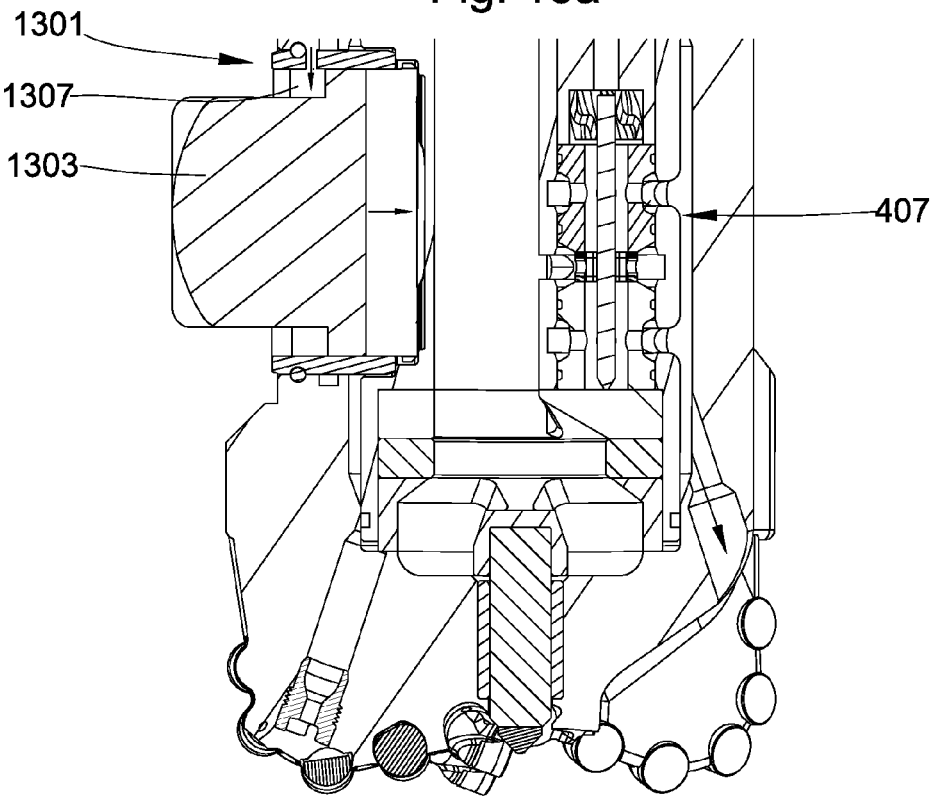
FIG. 13*b* is a cross-sectional view of another embodiment of a retraction mechanism.

FIGS. 13*a* and 13*b* disclose a retraction mechanism 1301 disposed adjacent an expandable element 1303. The retraction mechanism 1301 may comprise a compression spring, a tension spring, a spring mechanism, or a hydraulic mechanism. FIG. 13*a* discloses a spring mechanism 1305 retracting the expandable element as the valve 407 closes and fluid pressure in the fluid cavity is reduced.

FIG. 13*b* discloses a retraction mechanism 1301 comprising a hydraulic mechanism 1307. As the valve 407 closes, fluid may be directed into a hydraulic chamber 1307 that, when pressurized, returns the expandable element to its retracted position.

Whereas the present invention has been described in particular relation to the drawings attached hereto, it should be understood that other and further modifications apart from those shown or suggested herein, may be made within the scope and spirit of the present invention.

What is claimed is:

1. A downhole rotary steerable system, comprising:

a fluid path defined by a bore formed within a drill string component;

a nozzle disposed on the drill string component and configured to direct fluid towards a downhole formation;

an expandable element supported by the drill string component and configured to engage the downhole formation;

a valve disposed within the bore and in fluid communication with the bore and a fluid cavity;

wherein the fluid cavity is in fluid communication with both the nozzle and a mechanism for extending the expandable element;

wherein the nozzle is configured to erode a portion of the formation's wall away forming an eroded area, and the expandable element is configured to urge the drill string component into the eroded area; and wherein the operation of the nozzle and the expandable element is synchronized.

2. The system of claim 1, wherein the valve is configured to control flow from the bore to the fluid cavity.

3. The system of claim 1, wherein the mechanism for extending the expandable element comprises a surface on a back end of the expandable element, wherein when the fluid cavity is pressurized, fluid pressure exerts a force on the back end's surface to extend the expandable element.

4. The system of claim 1, wherein the drill string component comprises an orientation sensing mechanism that determines orientation of the nozzle and the expandable element.

5. The system of claim 1, wherein the drill string component comprises a generally outer annular surface, and the nozzle and the expandable element are both supported by the generally outer annular surface, but positioned opposite each other.

6. The system of claim 1, wherein the drill string component is a drill bit.

7. The system of claim 1, wherein the nozzle is positioned on a working face of the drill bit.

8. The system of claim 1, wherein the nozzle is positioned on a gauge of a drill bit.

9. The system of claim 1, wherein the fluid cavity comprises an annular geometry.

10. The system of claim 1, wherein the fluid cavity is formed between an inner surface of the drill string component and an outer surface of a housing inserted into the inner surface.

11. The system of claim 10, wherein the bore is formed in part by the housing.

12. The system of claim 10, wherein the valve is supported by the housing.

13. The system of claim 10, wherein at least one fluid seal is formed between the inner surface of the drill string component and the outer surface of the housing to maintain pressures within the fluid cavity.

14. The system of claim 1, wherein the expandable element comprises a retraction mechanism.

15. The system of claim 13, wherein the retraction mechanism comprises a compression spring, a tension spring, a spring mechanism, or a hydraulic mechanism.

16. The system of claim 1, wherein a diameter of the steering nozzle is smaller than a diameter of the valve such that a pressure differential is still created in the fluid cavity as fluid exits through the nozzle.

* * * * *